United States Patent [19]

Woollenweber

[11] 3,930,747

[45] Jan. 6, 1976

[54] TURBINE HOUSING

[75] Inventor: William Edward Woollenweber, Columbus, Ind.

[73] Assignee: Cummins Engine Company, Inc., Columbus, Ind.

[22] Filed: Nov. 28, 1973

[21] Appl. No.: 419,787

[30] Foreign Application Priority Data

| | | |
|---|---|---|
| Dec. 6, 1972 | United Kingdom | 56221/72 |
| Dec. 6, 1972 | United Kingdom | 56222/72 |
| Dec. 6, 1972 | United Kingdom | 56223/72 |

[52] U.S. Cl. ..... 415/205; 415/219 C; 60/605; 60/622

[51] Int. Cl. ..... F02b 37/00; F01d 1/08

[58] Field of Search ..... 415/205, 184, 211, 219 C, 415/203; 60/605, 622, 324, 312, 313, 314; 123/65 E

[56] References Cited

UNITED STATES PATENTS

| | | | |
|---|---|---|---|
| 2,899,797 | 8/1959 | Birmann | 60/605 |
| 3,005,618 | 10/1961 | Buchi | 415/184 |
| 3,218,029 | 11/1965 | Woollenweber | 415/205 |
| 3,292,364 | 12/1966 | Cazler | 415/205 |
| 3,408,046 | 10/1968 | Woollenweber | 415/184 |
| 3,614,259 | 10/1971 | Neff | 415/205 |
| 3,664,761 | 5/1972 | Zastrow | 415/205 |

*Primary Examiner*—William L. Freeh
*Assistant Examiner*—L. J. Casaneyola
*Attorney, Agent, or Firm*—Hibben, Noyes & Bicknell

[57] ABSTRACT

This invention relates to a turbine housing which includes at least two separate passageways for receiving a flow of fluid and carrying same to a volute section for introduction to a turbine wheel, a first of said passageways being arranged to surround at least 160° of a second of said passageways at the termination of said second passageway, the termination of said second passageway being at or upstream of the start of the volute section of the housing. The invention also includes a turbine and a turbocharger including the housing of the invention and an internal combustion engine in combination with such a turbocharger, and further includes the turbine housing of the invention in combination with an exhaust system in which exhaust ducts merge together at least one duct surrounding at least 160° of another duct at the point of juncture.

30 Claims, 34 Drawing Figures

Figure 1:
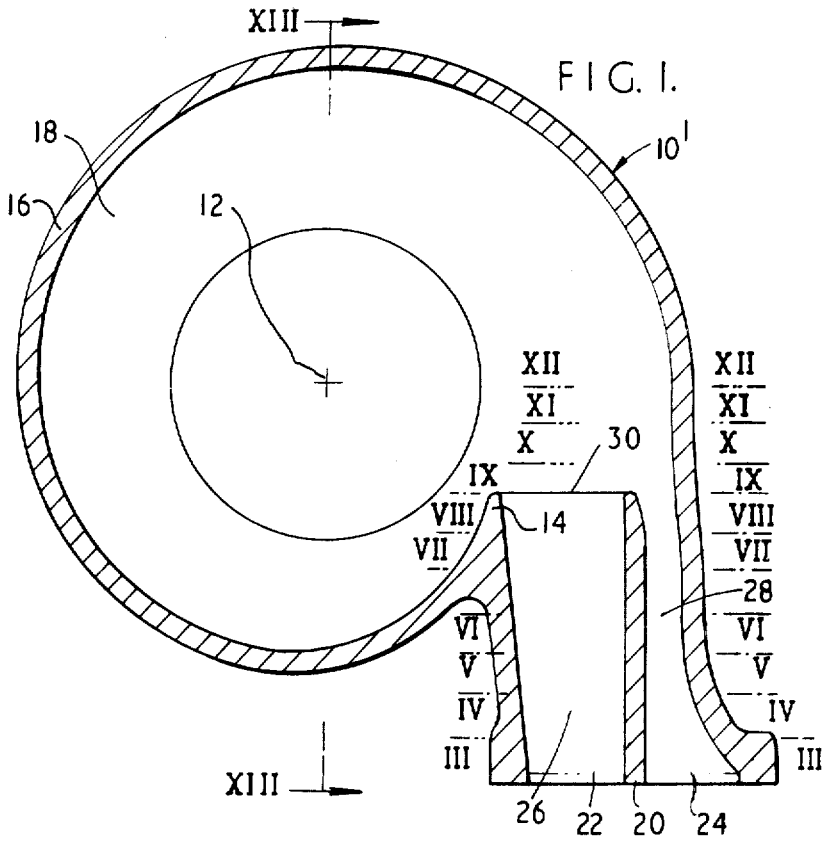

FIG. 3.
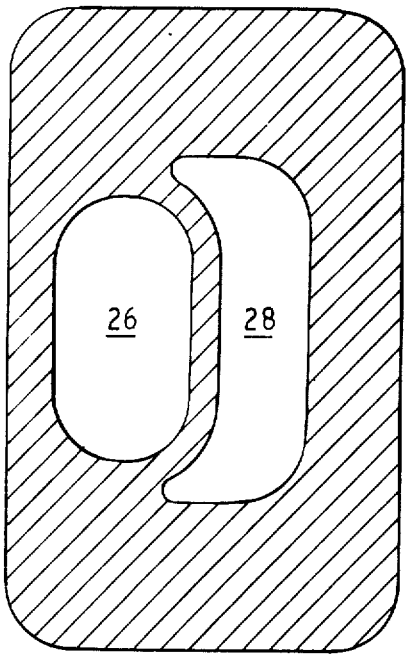
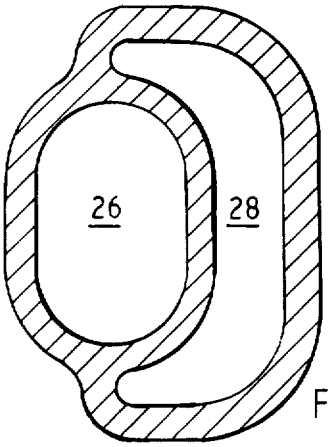
FIG. 4.
FIG. 5.
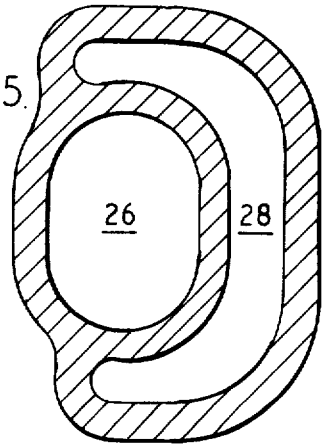

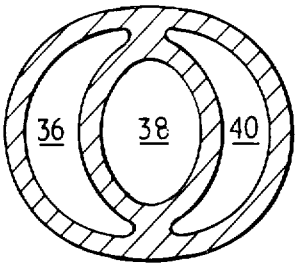
FIG. 17.
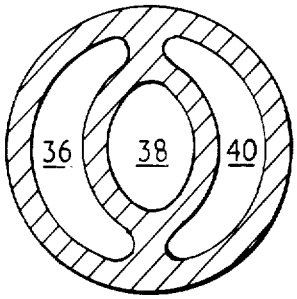
FIG. 18.
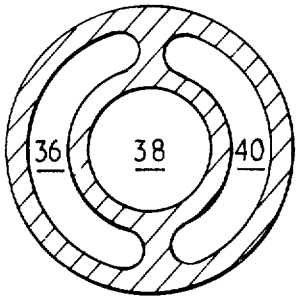
FIG. 19.
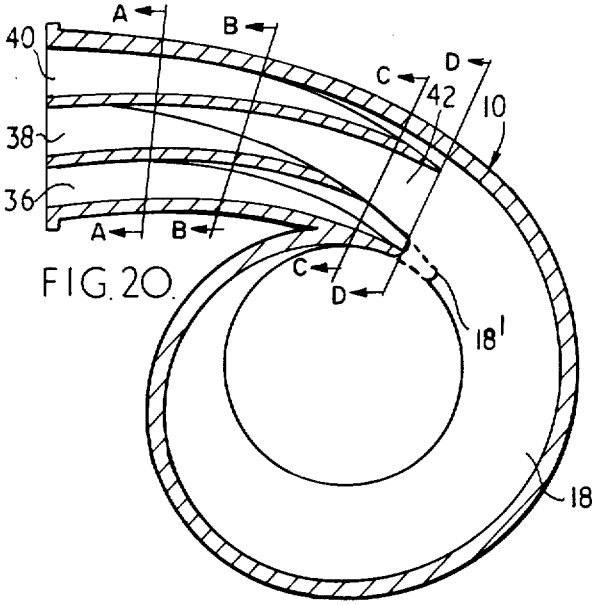
FIG. 20.
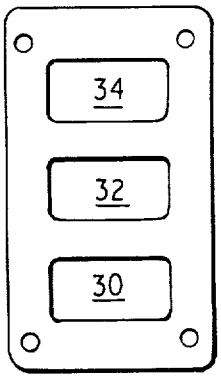
FIG. 21.
FIG. 22.
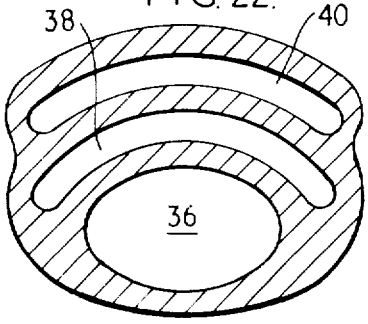
FIG. 23.
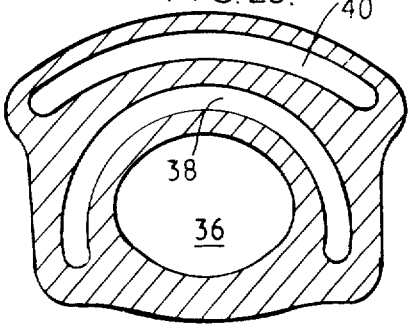

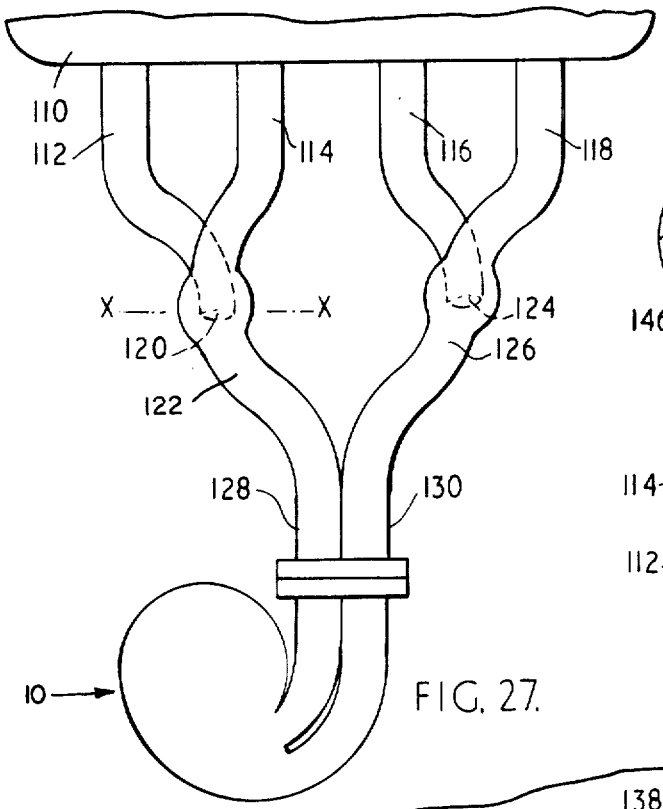
FIG. 27.
FIG. 30.
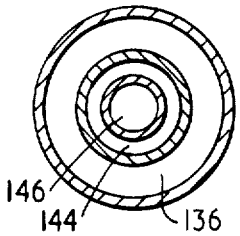
FIG. 28.
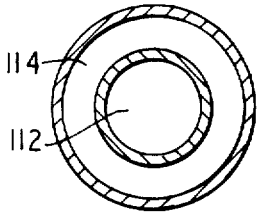
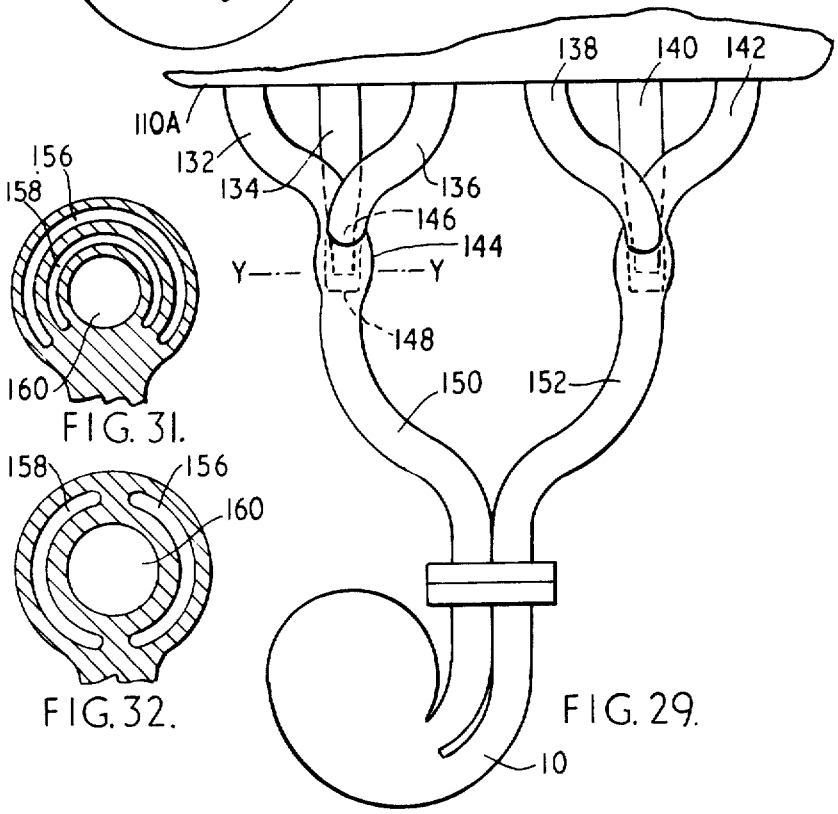
FIG. 31.
FIG. 32.
FIG. 29.

TURBINE HOUSING

The present invention relates to turbine housings.

The purpose of a turbine housing is firstly to contain the turbine wheel and secondly, and of more importance, to introduce the fluid to the wheel in such a manner as to allow the wheel to extract as much energy from the fluid as possible.

One mechanical design configuration which has been extensively used in the past, is a nozzle ring located around the periphery of the turbine wheel, the purpose of which is to increase the speed of the fluid prior to its introduction to the turbine wheel and to direct the fluid toward the wheel at the proper angle of approach. Since the nozzle ring provided the velocity increase necessary to drive the turbine wheel, early turbine housings used in connection with nozzle rings merely distributed the gas flow as evenly as possible around the periphery of the nozzle ring at a relatively low approach velocity.

One widespread use of turbines is in combination with a centrifugal compressor to form a device called a turbo compressor, e.g. a turbocharger, which may be used in supercharging the cylinders of an internal combustion engine or in producing a supply of compressed air. The drive for the turbine in such a device is normally supplied by the exhaust gases discharged from the cylinders of the internal combustion engine. In such an arrangement the exhaust system of the internal combustion engine is connected through appropriate ducting to the turbine housing and the turbine must function on intermittent or pulsating exhaust gas flow. As the output requirement of the internal combustion engine is increased, it becomes advantageous to use a divided manifold system in which exhaust gases from the various cylinders are ducted through one of several separate branches, the arrangement desirably being such that exhaust gases are alternately fed through the branches, e.g, in a 6-cylinder engine having a firing order 1-5-3-6-2-4- exhaust gases from cylinders 1, 2 and 3 may be ducted through one branch and exhaust gases from cylinders 4, 5 and 6 ducted through another branch.

The advantage of using separate branches for the exhaust gases is that the static pressure in each branch is allowed to fall to a low value between each exhaust pulse through that branch thereby lowering the pumping loss of the engine. In systems using a single branch for exhaust gases from all cylinders the static pressure remains at a high level as the exhaust pulses are closer together than when the exhaust gases are passed into separate branches.

In one conventional type of turbine housing used on tubochargers the gases from two separate manifold branches arefed to two volute passages which are then used to carry the separated exhaust gas flow to the turbine wheel, each volute passage introducing gas to approximately 180° of the turbine wheel periphery. Such an arrangement knwon as a "double flow" turbine housing involves alternate pulses being fed to opposite sides of the turbine wheel, resulting in efficiency losses associated with partial admission operation of the turbine, and also resulting in bearing system difficulties caused by alternating lateral forces being applied to opposite sides of the turbine wheel.

In another arrangement, known as the "twin flow" turbine housing, the turbine housing volute is separated into two passages side by side each receiving exhaust gases from one of the two branches and each feeding approximately 360° of the turbine wheel periphery.

By appropriate sizing of the passages of the turbine housing leading to the volute section in both the above types of housing, the speed of the exhaust gases may be maintained or increased and the costly nozzle ring thus may be eliminated.

The twin flow turbine housing eliminates the partial admission loss problem of the double flow type and also the problems associated with alternate introduction of gases at opposite sides of the turbine wheel. The twin flow housing however contains inherent efficiency loss since the effluent annulus of each of the twin flow passages is clearly much small than the inlet annulus of the turbine wheel. The gas flow occurs alternately in each of the twin flow passages and results in a sudden expansion of the gas as it emerges from the twin volute and before it enters the turbine wheel. In addition, the twin flow turbine housing has a serious mechanical problem in that the meridianal wall dividing the volute is subject to heat distortion and cracking when subjected to intense temperature fluctuations present in the exhaust gas flow. The double flow turbine housing also includes an internal hot dividing wall but since it is attached to the housing outer wall at both ends the distortion and cracking problem is not as serious as with the twin flow type.

A third type of prior art turbine housing disclosed in U.S. Pat. No. 3,408,046, is one which also eliminates the partial admission losses of the double flow type, eliminates the meridinal divider wall of the twin flow type and accepts exhaust gas flow from a two branch divided exhaust manifold. This type known as a "semi-divided type", contains a divider wall beginning at the housing inlet flange and terminating prior to or at the start of the volute section of the housing. This partial divider wall separates two side by side convergent passageways which function to increase the velocity of the exhaust gases prior to entering the volute section of the housing.

The present invention provides a turbine housing which retains advantages of the semi-divided type, but embodies the important additional advantage of a means of aspirating each of the divided manifold branches to which it is connected.

According to the present invention there is provided a turbine housing comprising at least two inlets each arranged to receive a pulsating or intermittent flow of fluid e.g. exhaust gas, a separate passageway connected to each said inlet, a first of said passageways being arranged to surround at least 160° of a second of said passageways at the termination of said second passageway.

In a preferred embodiment of the present invention the termination of said second passageway being at or upstream of the start of the volute section of the housing.

Preferably said first passageway surrounds at least 180° of said second passageway and more preferably from 270° to 360° of the second passageway at the termination of said second passageway.

In order to avoid flow problems through the passageways they are preferably gradually altered from the inlet, where they are usually side by side to the point of merger where one at least partially surrounds another.

Each passageway may remain constant in cross-sectional area to the point at which it merges with another passageway or if desired or necessary the cross-sectional area of each passageway may be reduced (preferably gradually) from the inlet to the point of merger with another passageway so as to maintain or increase the speed of fluid through the passage. In a further arrangement a so-called "supersonic nozzle" effect may be achieved by sizing each passageway so as to have an axial section in which the cross-sectional area decreases (preferably gradually) followed by a section in which the cross-sectional area increases (preferably gradually). The passageways may thus be in the form of nozzles of varying area ratios and area schedules.

Where the housing includes three inlets and three passageways the three passageways may merge at a single point (at/or near the start of the volute section of the housing) or two of the passageways may merge first with the third passageway subsequently merging with the passageway formed by merging the first and second passageways. In the former case preferably each of two passageways surrounds at least a 160° portion of the third passageway at the point of merger. In the latter case the first passageway surrounds at least 160° of the second passageway at the point of merger and the third passageway surrounds at least 160° of the merged first and second passageways at the point of memrger of the third passageway therewith.

According to a further feature of the present invention there is provided a turbine housing comprising at least two inlets each arranged to receive a flow of fluid, a separate passageway connected to each said inlet, one or more of said passageways being arranged to surround at least 270° of a further one of said passageways at the termination of said further passageway and a volute section in communication with said passageways, the termination of said further passageway being at or upstream of the start of the volute section of the housing.

The effect of the housing of the present invention is that as fluid e.g. exhaust gas from different cylinders of an internal combustion engine is alternately passed through the passageways (as in the case of divided exhaust gas flow from an internal combustion engine) an induced gas flow (or aspirating effect) is achieved in the other passageway or passageways in which little gas flow is occurring thereby reducing the static pressure existing in that passageway or passageways.

Although the turbine housing of the invention preferably includes only a single volute, it is envisaged that more than one volute may be used if desired. For example it may be convenient where the gas flow to the housing is from a V - 8 internal combustion engine, to feed the exhaust gases from one bank of cylinders to one volute and the exhaust gases from the other bank of cylinders to a second volute. Each bank of cylinders will have at least two exhaust branches connected to separate inlets on the housing, the housing including a separate series of merging passageways for each volute section.

Where reference is made throughout the specfication and claims to internal combustion engines, this is intended to include all types of internal combustion engine including diesel engines, rotary engines etc.

The housing of the present invention may result in one mor more of the following advantages:

i. no hot internal wall extending around the periphery of the turbine wheel is necessary as in the twin flow housing. Thus the problem of cracking and distortion of this wall is avoided.

ii. the partial admission loss of the double flow housing is eliminated iii. the sudden expansion loss of the twin flow housing is eliminated iv. the housing may be designed to produce a definite direction to the gas flow emerging from the passageways into the volute v. the alternating lateral force exerted on the turbine wheel in the double flow housing is eliminated since the gas flow is substantially uniformly introduced around the periphery of the wheel.

vi. A smaller and less costly housing may be obtained than the double flow and twin flow housing types.

vii. When in combination with an internal combustion engine, the engine pumping loss is reduced by the aspirating effect which creates lower static pressure in the exhaust manifolds resulting in improvement in fuel consumption and/or power output.

Various advantages result from the combination of a turbine housing constructed according to the present invention with an exhaust system comprising two ducts joining to form a common duct in such a manner that one of said ducts surrounds at least 160° of the other duct at the point at which they join, and two further ducts where merge to form a further common duct, one of said two further ducts surrounding at least 160° of the other further duct at the point of merger, and said common ducts connecting one with each inlet of the turbine housing.

The above exhaust system is for a four-cylinder internal combustion engine. However an exhaust system for a six-cylinder engine can also be advantageously coupled with a turbine housing constructed according to the present invention. In such a case the exhaust system comprises three ducts which merge to form a common duct, one direct first merging with a second duct and the duct so formed subsequently merging with the third duct, three further ducts merging in the same manner to form a further common duct, said common ducts connecting with the turbine housing inlets. Alternatively the three ducts and said three further ducts can simultaneously merge to form said common ducts.

To increase the velocity of the exhaust gases, the ends of the exhaust ducts connecting with the turbine housing can be modified to form tapered nozzle sections.

Figure 2:
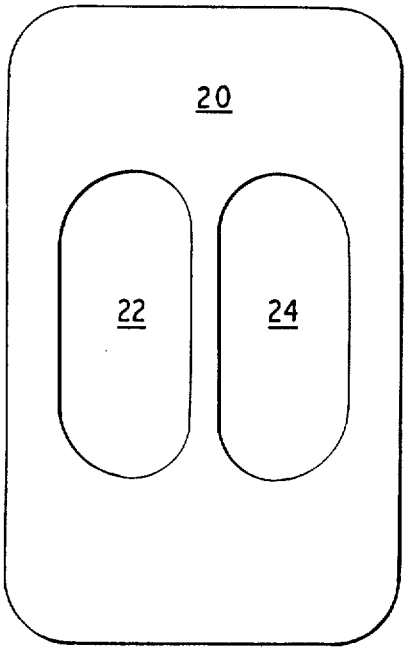
Figure 6:
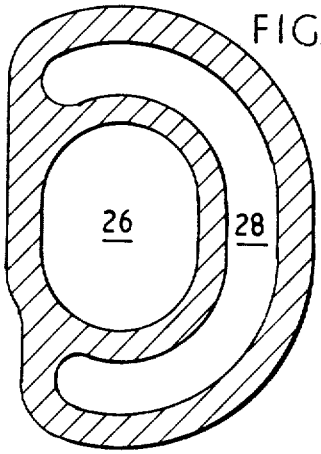
Figure 7:
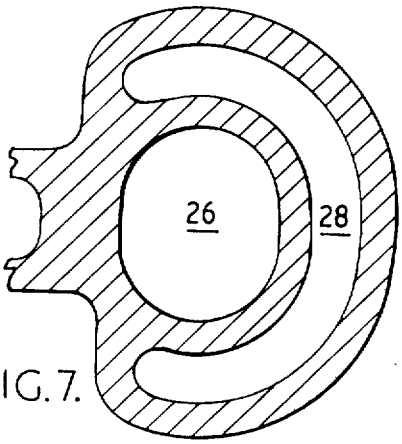
Figure 8:
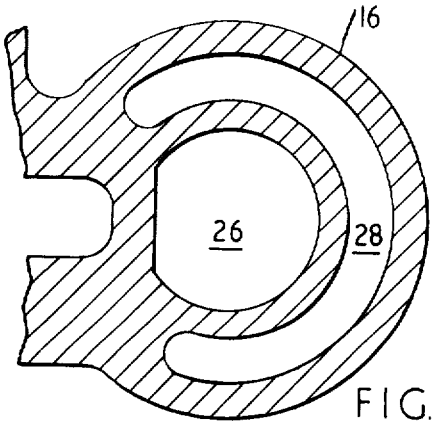
Figure 9:
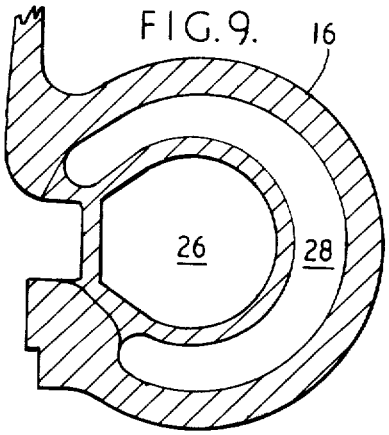
Figure 10:
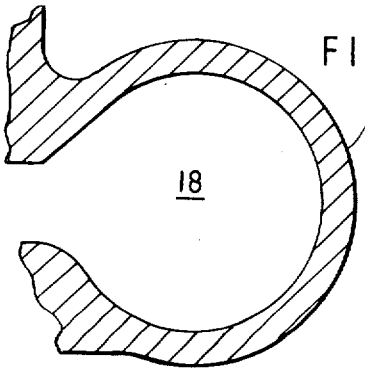
Figure 11:
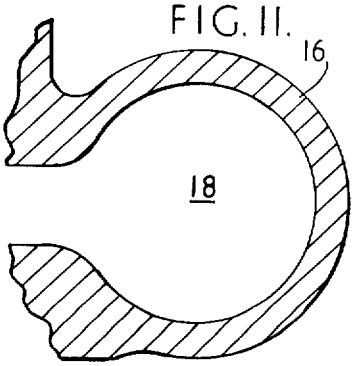
Figure 12:
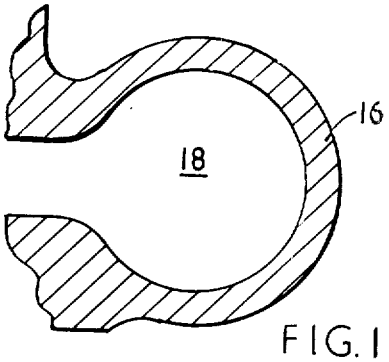
Figure 13:
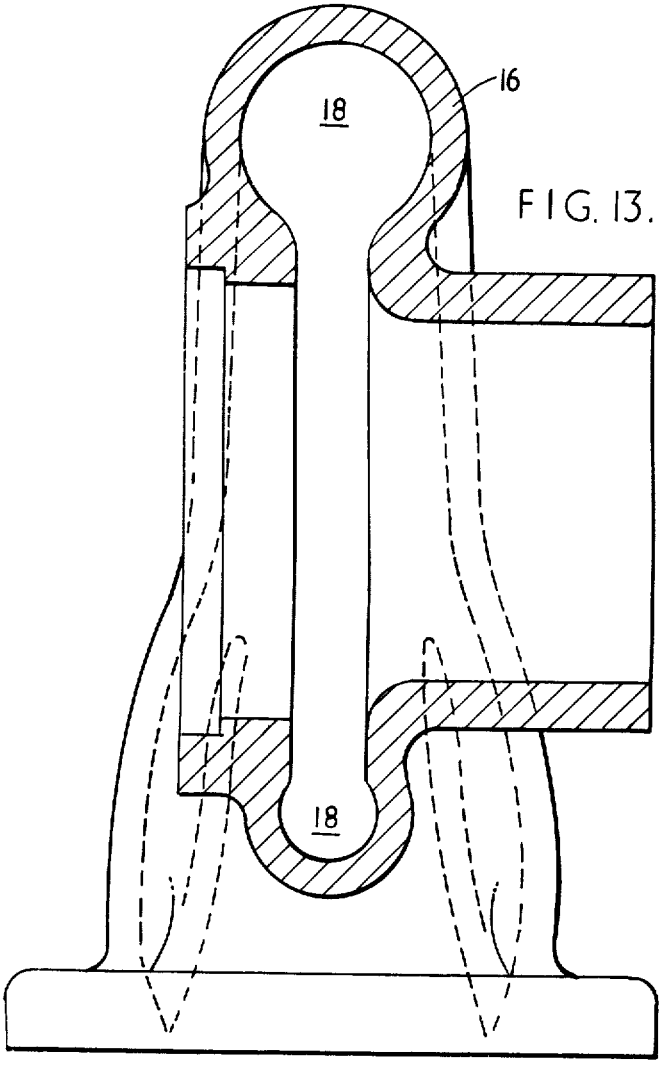
Figure 14:
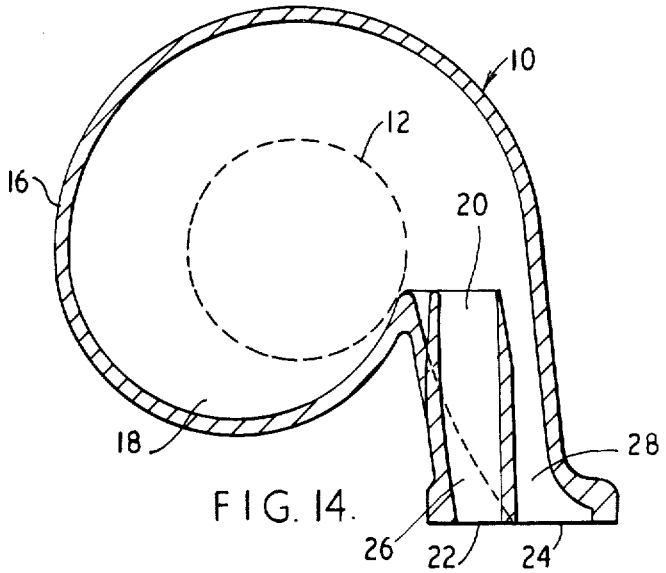
Figure 15:
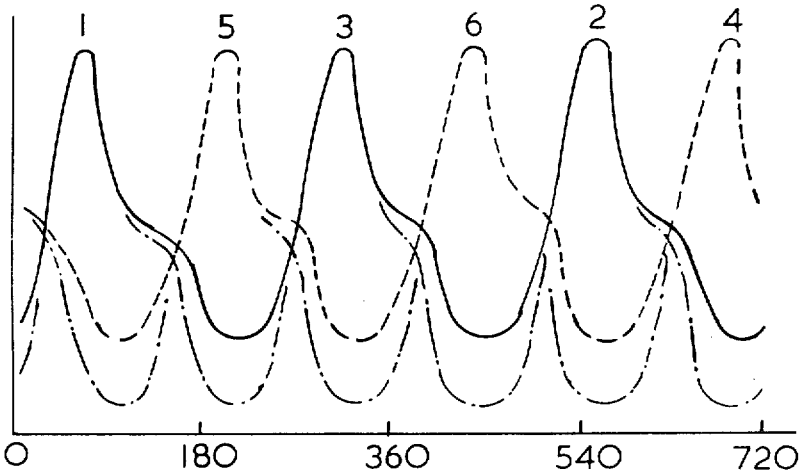
Figure 16:
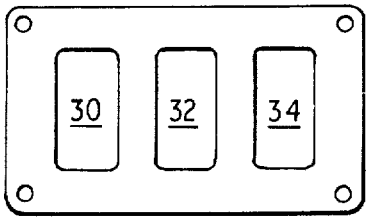
Figure 24:
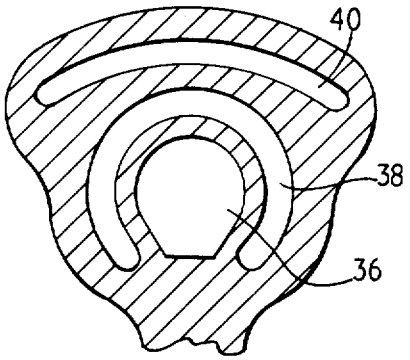
Figure 25:
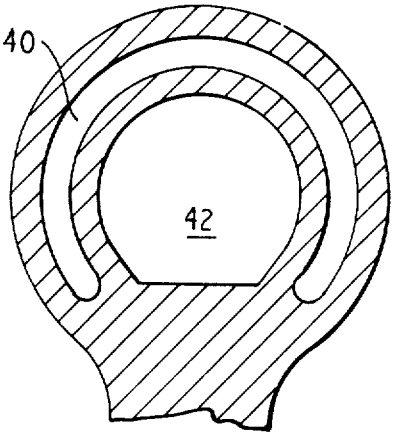
Figure 26:
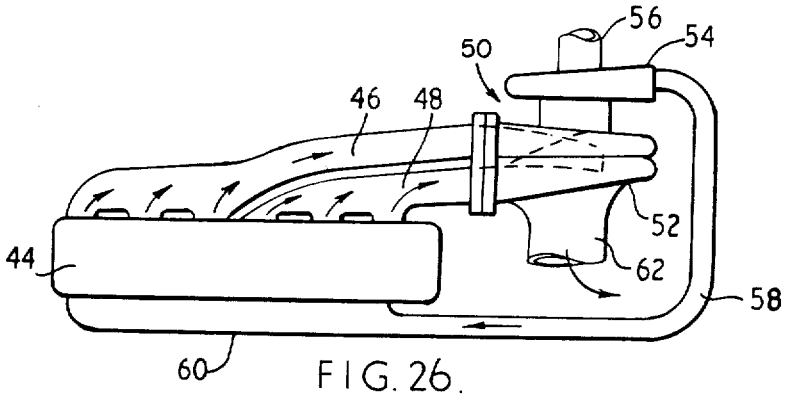

The invention will now be further described by way of example with reference to the accompanying drawings, in which:

FIG. 1 is a cross-sectional view of a turbine housing embodying the present invention, FIG. 2 is a view of the turbine housing of FIG. 1 illustrating the inlets to the turbine housing, the remainder of the housing being omitted for the sake of clarity, FIGS. 3 to 13 are cross-sectional view of the inlet of the turbine of FIG. 1 along the lines III—III, IV—IV, V—V, VI—VI, VII—VII, VIII—VIII, IX—IX, X—X, XI—XI, XII—XII and XIII—XIII respectively, the backgrounds of each sectional view being omitted for the sake of clarity, FIG. 14 is a view similar to FIG. 1 of a modified turbine housing in accordance with the invention, FIG. 15 is a graph comparing static pressures in an exhaust system feeding a conventional turbine and an exhaust system feeding a turbine having a housing in accordance with the present invention, FIGS. 16 to 19 are views, (some sectional) of a further modified housing in accordance with the invention, FIG. 20 is a side view partly cut away of a further modified housing in accordance with the invention, FIG. 21 is a view of the inlet configuration of the housing of FIG. 20, FIGS. 22 to 25 are cross-sectional views taken along lines A—A, B—B, C—C and D—D respectively of FIG. 20, and FIG. 26 is a diagrammatic view showing the manner in which a turbine including a housing of the present invention may be used in connection with the supercharging of an internal combustion engine.

Figure 33:
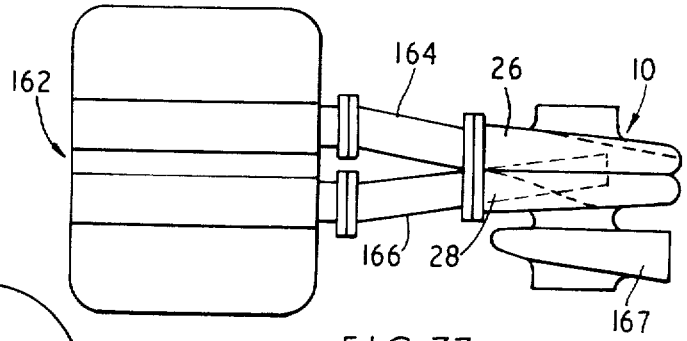
Figure 34:
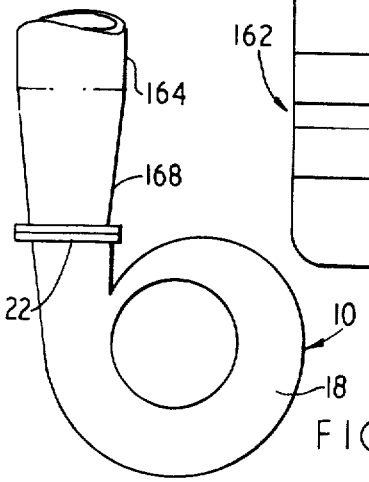

FIG. 27 illustrates diagrammatically an exhaust system for a four cylinder engine connected with a turbine housing constructed according to the present invention, FIG. 28 is a sectional view along X—X of FIG. 27, FIG. 29 illustrates diagrammatically an exhaust system for a six cylinder engine connected with a turbine housing constructed according to the present invention, FIG. 30 is a sectional view along line Y—Y of FIG. 29, FIG. 31 shows an alternative arrangement to that shown in FIGS. 29 and 30 for merging three exhaust ducts, FIG. 32 shows a further alternative arrangement to that shown in FIGS. 29 and 30 for merging three exhaust ducts, FIG. 33 is a sketch showing a rotary engine in combination with a turbine housing constructed according to the present invention, and FIG. 34 is a cross-sectional view of a turbine housing constructed according to the present invention, connected to an exhaust duct via a nozzle section.

Referring to FIGS. 1 to 13 there is shown a turbine housing indicated generally by the numeral 10. The turbine wheel rotates about axis 12 and the blades of the turbine are of a length so as to just clear the housing at 14 when rotating. It can be seen that outer wall 16 of the housing defines a volute 18 which will progressively introduce fluid entering the volute to the turbine wheel over nearly the whole 360° of its periphery.

Face 20 of the housing 10 includes two inlet passageways 22, 24 located side by side. These inlets may be connected to separate branches of an exhaust manifold of an internal combustion engine. Connected to inlets 22, 24 are passageways 26, 28 and it can be seen from FIGS. 3 to 9 that passageways 26, 28 gradually alter in shape so that at the point of termination of the passageways 30, which coincides with the start of the volute 18 passageway 28 surrounds approximately 280° of the periphery of passageway 26. Both passageways are also gradually reduced in cross-sectional area over their length in order to increase the speed of fluid passing therethrough.

In operation exhaust gas is fed alternately through inlets 22, 24 to passageways 26, 28 respectively. The fluid leaves passageways 26, 28 at 30 and passes through volute 18 into the turbine wheel (not shown) causing its rotation. As exhaust gas leaves passageway 28 it exerts an aspirating effect on passageway 22 thereby lowering the static pressure in this passageway and thus in the exhaust manifold connected thereto.

Similarly as exhaust gas leaves passageway 26 it exerts an aspirating effect on passageway 28, lowering the static pressure in passageway 28 and thus in the exhaust manifold connected thereto.

Referring now to FIG. 14 there is shown a view similar to that of FIG. 1 but of a modified turbine housing. In this Figure the same numerals have been used as in FIGS. 1 to 13 to designate similar parts. The housing is similar to that of FIGS. 1 to 13 but modified by increasing the length of the passageways 24, 26 so that at the termination of passageways 24, 26 (which coincides with the start of the volute section 18), passageway 28 surrounds the full 360° of the periphery of passageway 26.

Referring now to FIG. 15 the graph shown plots static pressure in each of two branches of a divided exhaust manifold which is connected to a turbo-charger against the degree of rotation of the crankshaft of a six cylinder internal combustion engine. The solid line indicates the static pressure in the branch connected to cylinders 1, 2 and 3 and the dotted line indicates the static pressure in the branch connected to cylinders 4, 5 and 6 when the turbine housing is of a conventional type. The dot-dashed line indicates the static pressure when the turbo-charger includes a turbine housing in accordance with the present invention. It can be seen that lower static pressures in each branch of the manifold may be achieved when using a turbine housing made in accordance with the present invention.

Referring now to FIGS. 16 to 19 a series of views is shown similar to FIGS. 2 to 12 but for a turbine housing for connecting directly to a three branch exhaust system (not shown). Three inlets 30, 32, 34 located side by side are provided each for connection to a separate branch of the exhaust system and these inlets 30, 32 34 connect to passageways 36, 38 and 40 respectively which develop in the manner shown in FIGS. 17, 18 19 to a point (shown in FIG. 19) at which the passageways merge into a single passageway. This point coincides with the start of the volute section (not shown) of the housing. At this point each of the passageways 36, 40 surrounds at least 160° of the periphery of the passageway 38. As the passageways alter in shape from the inlet to the point shown in FIG. 19 their cross-sectional areas are also gradually decreased in order to produce a nozzle effect.

In operation pulses of exhaust gas leaving passageway 38 will have an aspirating effect on passageways 36 and 40 and similarly pulses of exhaust gas leaving each of passageways 36 and 40 will have an aspirating effect on the other two respectively.

FIGS. 20 and 25 show a further modified turbine housing for use in direct connection with a three branch exhaust system of an internal combustion engine. Three inlets 30, 32, 34 are located in side-by-side relationship and connect with passageways 36, 38, 40 respectively. The manner in which these passageways develop can be seen from FIG. 21 and FIGS. 22 to 25. Again as the passageways change crosssectional shape their cross-sectional area may be gradually reduced thereby forming a nozzle. Alternately, each passage may be constant in cross sectional area along its length. At a point upstream of the start of the volute 18, passageway 36 terminates, and it can be seen from FIG. 24 that at this point passageway 38 surrounds approximately 280° of the periphery of the passageway 36. Passageways 36, 38 thus merge to form passageway 42. At the point of termination of passageway 40, 42 which coincides with the start of the volute section 18, passageway 40 surrounds approximately 280° of the periphery of the passageway 42.

The portion of the housing wall indicated at 18' may be extended as shown by the dotted line to provide a single transition section before the start of the conventional volute section of the housing.

In operation pulses of exhaust gas leaving passageway 40, will have an aspirating effect on passageway 42, which in turn lowers the static pressures in each of passageways 36, 38. Pulses of exhaust gas leaving passageway 42 have an aspirating effect on passageway 40. A similar effect is achieved between passageways 36 and 38, pulses of exhaust gas leaving one of these passageways has an aspirating effect on the other passageway as well as on passageway 40.

Referring now to FIG. 26 and internal combustion engine 44 includes six cylinders (not shown), which feed exhaust gases into a pair of exhaust branches 46, 48. Cylinders 1, 2 and 3 feed exhaust gases into branch 46 and cylinders 4, 5 and 6 feed exhaust gases into branch 48. The turbo-charger indicated generally at 50 comprises a turbine component 52 and a compressor component 54. The compressor may be of any suitable design and receives air through an intake 56 and drives compressed air through passage 58 into the inlet manifold 60 of the internal combustion engine 44 thereby supercharging the cylinders. The turbine 52 includes a turbine housing of the present invention and receives exhaust gases from the branches 46, 48 which drive the turbine which in turn drives the compressor 54. Exhaust gases after passing through the turbine exhaust from the outlet 62 to the atmosphere through suitable exhaust cleaning devices or other conventional types of exhaust gas systems.

Referring now to FIGS. 27 and 28 of the drawings, a four cylinder internal combustion engine indicated by the reference numeral 110 exhausts via four ducts 112, 114, 116 and 118. Ducts 112 and 114 merge at 120 to form a single duct 122 and it can be seen from FIG. 28 that at this point duct 114 surrounds 360° of duct 112. Ducts 116 and 118 combine in similar manner at point 124, to form a single duct 126. Ducts 122 and 126 are connected to a turbine 10 as described hereabove.

In operation the cylinders exhaust in the order 1-3-2-4 and it can be seen that pulses of exhaust gas passing through duct 112 will aspirate duct 114 and pulses of exhaust gases passing through duct 114 will aspirate duct 112. Likewise exhaust gases passing through ducts 116 and 118 will have an aspirating effect on the other of these two ducts. A similar effect is achieved between ducts 122 and 126 at the point at which they merge. At each point of merger of the various ducts, an aspirating effect is obtained and this results in lower static pressures in the exhaust ducts with consequent reduction in the pumping effect necessary by the engine to overcome this static pressure.

Referring now to FIGS. 29 and 30, a six cylinder internal combustion engine indicated by the numeral 110A exhausts into ducts 132, 134, 136, 138, 140 and 142. Ducts 132 and 134 merge to form a common duct 144 at point 146, and this duct 144 subsequently merges with duct 136 at point 148 to form duct 150. At point 146 duct 134 surrounds 360° of duct 132 and as can be seen from FIG. 30 duct 136 surrounds 360° of duct 144 at point 148. Ducts 138, 140 and 142 combine in similar manner to form a single duct 152. Ducts 150 and 152 are lead into a turbine housing 10 as illustrated in FIGS. 1 to 13. The turbine housing 10 forms part of a turbine of a turbocharger used to super-charge the engine 110A.

In operation the engine exhausts gases from the cylinders in the order 1-5-3-6-2-4- and in a similar manner to that described in connection with FIG. 27 and it can be seen that the exhaust gas passing through each of the various ducts will have an aspirating effect on any other ducts with which it merges. By following the path of a single exhaust pulsation from any one of the six cylinders it will be seen that taking into effect the aspirating effect created by the turbine housing 54 this operation will have an aspirating effect on all five of the remaining exhaust manifold pipes thereby lowering the static pressure in each pipe.

Referring now to FIG. 31 this shows an alternative manner in which three ducts may be merged to form a single duct. In this arrangement three ducts 156, 158, 160 are merged simultaneously to form a single duct (not shown). At the point of merger duct 156 surrounds approximately 270° of duct 158 which in turn surrounds approximately 280° of duct 160.

FIG. 32 shows a further alternative embodiment in which three ducts are simultaneously merged to form a common duct. In this embodiment each of ducts 156, 158 surround approximately 160° of duct 160 at the point of merger.

Referring now to FIG. 33, a multi-lobe rotary combustion engine 162 is connected via manifolds 164, 166 with a turbine housing 10. The turbine housing is of the type described hereabove with reference to FIGS. 1 to 13 and like reference numerals will be used hereafter for equivalent parts of housing. The two inlets 22, 24 of the housing 10 are connected respectively to manifolds 164, 166. Each inlet develops into a passageway 26, 28 and the two passageways merge at a point at or just upstream of the volute section 18 of the housing, one of said passageways 26 surrounding at least 160° (preferably at least 180°, more preferably from 270° to 360°) of the second passageway 28 at the termination of the second passageway 28. The turbine wheel (not shown) is mounted on a shaft (not shown) which also carries a compressor component 167.

In operation exhaust gases are alternately fed by the two lobes (not shown) of the engine 162, through passageways 164 and 166 and thence into the turbine 10. It can be seen from this Figure that the passageways 164, 166 connecting the engine exhaust ports to the turbine housing inlets 22, 24, are extremely short and are of simple shape.

In a modified arrangement the passageways 164, 166 may be eliminated by matching the inlet ports of the turbine housing 10 with the exhaust ports of the engine 162. The turbine housing will then be mounted directly onto the engine exhaust ports.

To attain the desired velocity of the exhaust gases on entry into the volute section of turbine housing 10, a nozzle 168 (FIG. 34) is provided at the end of each exhaust duct 164, 166 connecting with the inlets (22, 24) of the turbine housing 10. Alternatively this nozzle section can be formed within the turbine housing. All the above described embodiments may be provided with such a nozzle section. However, if the exhaust gas velocity is sufficient the nozzle section may, if desired, be omitted.

I claim:

1. In a centripetal flow turbine housing having a first inlet and a first inlet passageway receiving fluid flow and a volute section connected to said first inlet passageway for discharging said fluid flow, the improvement comprising at least one additional inlet spaced from said first inlet means forming at least one additional inlet passageway for receiving fluid flow from said additional inlet and defining an outlet for directing said fluid flow in a direction which is substantially parallel to the direction of flow through said first inlet passageway, said additional inlet passageway being surrounded at some point downstream from said inlets by at least 160° of said first inlet passageway as viewed in a plane generally normal with respect to the flow through said additional inlet passageway.

2. In a centripetal flow gas driven turbine adapted to receive gas from at least two gas supply ducts, the improvement of a turbine housing forming a volute section, said housing including means forming a first inlet and a first passageway leading from said first inlet to said volute section, said first inlet being adapted to be connected to one of said supply ducts, said housing further including means forming a second inlet spaced from said inlet and connected to another of said supply ducts and a second passageway leading from said second inlet to an outlet, said outlet being surrounded at some point downstream from said inlets by said first passageway to an extent of at least 160° as viewed in a plane generally normal with respect to the flow of gas through said passageways.

3. In an internal combustion engine including a plurality of combustion chambers which fire in a sequential firing order, an intake manifold for supplying fresh intake air to said chambers, and a turbocharger including a compressor connected to said intake manifold, the improvement comprising a divided exhaust duct system connected to conduct exhaust gases from said chambers, said duct system including a first branch connected to one of said chambers and a second branch connected to another of said chambers, and a housing of a centripetal turbine of said turbocharger, said housing including a volute section, means forming a first inlet and a first passageway leading from said first inlet to said volute section, said first inlet being adapted to be connected to one of said branches, said housing further including means forming a second inlet spaced from said first inlet and connected to another of said branches, and a second passageway leading from said second inlet to an outlet, said outlet being surrounded at some point downstream from said inlets by said first passageway to an extent of at least 160° as viewed in a plane generally normal with respect to the flow of gas through said passageways.

4. In a centripetal flow turbine housing having a first inlet opening and an inlet passage receiving fluid flow and a volute section for discharging said fluid flow, the improvement comprising at least one additional inlet opening spaced from said first inlet opening, means for forming at least one additional inlet passage also receiving fluid flow from said additional inlet opening and defining an outlet surrounded at some point downstream from said inlet openings by at least 160° of said inlet passage as viewed in a plane generally normal with respect to the flow through said additional inlet passage.

5. A housing according to claim 1, wherein said first passageway surrounds at least 180° of said second passageway.

6. A housing according to claim 1, wherein the first passageway surrounds from 270° to 360° of the second passageway.

7. A housing according to claim 1, wherein the passageways are gradually altered in shape from the inlet to the point of merger where one at least partially surrounds another.

8. A housing according to claim 1, where the cross-sectional area of each passageway is gradually reduced from the inlet to the point of merger with another passageway.

9. A housing according to claim 1 which includes only two passageways, which passageways merge at the start of the volute section of the housing.

10. A housing according to claims 1 which includes only two passageways, which merge at a point upstream of the start of the volute section of the housing.

11. A housing according to claim 1, which includes three passageways which merge at the start of the volute section of the housing.

12. A housing according to claim 1, which includes three passageways which merge at a point upstream of the start of the volute section of the housing.

13. A housing according to claim 11 wherein each of two passageways surrounds at least a 160° portion of the third passageway at the point of merger.

14. A housing according to claim 12, wherein each of two passageways surrounds at least a 160° portion of the third passageway at the point of merger.

15. A housing according to claim 1, which includes three passageways two of which merge to form a common passageway which merges with the third passageway, the first passageway surrounding at least 160° of the second passageway at the point of merger and the third passageway surrounding at least 160° of the merged first and second passageways at the point of merger of the third passageway therewith.

16. A turbine including a housing according to claim 1.

17. A turbocharger including a turbine according to claim 16.

18. In combination an internal combustion engine and a turbocharger according to claim 16.

19. A turbine housing according to claim 1, in combination with an exhaust system comprising two ducts joining to form a common duct in such a manner that one of said ducts surrounds at least 160° of the other duct at the point at which they join, and two further ducts which merge to form a further common duct, one of said two further ducts surrounding at least 160° of the other further duct at the point of merger, said common ducts connecting one with each inlet passageway of the turbine housing.

20. A turbine housing according to claim 1, in combination with an exhaust system comprising three ducts which simultaneously merge to form a single duct, each of two of said ducts surrounding at least 160° of the third duct, and three further ducts which merge together simultaneously to form a further single duct each of two of said further ducts surrounding at least 160° of the third further duct, said single ducts connecting with the turbine housing inlet passageways.

21. A turbine housing according to claim 1, in combination with an exhaust system comprising three ducts which merge to form a common duct, one duct first merging with a second duct and the duct so formed subsequently merging with the third duct, three further ducts merging in the same manner to form a further common duct, said common ducts connecting with the turbine housing inlets.

22. A turbine housing according to claim 1, in combination with a rotary engine.

23. A turbine housing according to claim 19, in combination with a rotary engine.

24. A turbine housing according to claim 20, in combination with a rotary engine.

25. A housing according to claim 21, in combination with a rotary engine.

26. A turbine housing according to claim 22, characterised in that an exhaust duct connects with an inlet of the housing, a tapered nozzle section of the duct connecting with the inlet.

27. A turbine housing according to claim 19, characterised in that an exhaust duct connects with an inlet of the housing, a tapered nozzle section of the duct connecting with the inlet.

28. A turbine housing according to claim 20, characterised in that an exhaust duct connects with an inlet of the housing, a tapered nozzle section of the duct connecting with the inlet.

29. A turbine housing according to claim 21, characterised in that an exhuast duct connects with an inlet of the housing, a tapered nozzle section of the duct connecting with the inlet.

30. A turbine housing according to claim 1, characterised in that an exhaust duct connects with an inlet passageway of the housing, a tapered nozzle section of the duct connecting with the inlet passageway.

* * * * *